US008171658B2

(12) United States Patent
Samuels et al.

(10) Patent No.: US 8,171,658 B2
(45) Date of Patent: May 8, 2012

(54) SNOWSHOE WITH FLEXIBLE TAIL

(75) Inventors: Rudy Lucas Samuels, San Francisco, CA (US); Chris Barchet, Seattle, WA (US); Dodd Grande, Seattle, WA (US); Mark S. Williams, Seattle, WA (US); Scott Youmans, Seattle, WA (US); Rachel Lin, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 634 days.

(21) Appl. No.: 12/313,913

(22) Filed: Nov. 24, 2008

(65) Prior Publication Data

US 2010/0126046 A1 May 27, 2010

(51) Int. Cl.
*A43B 5/04* (2006.01)
*A43B 5/00* (2006.01)

(52) U.S. Cl. ..... 36/124; 36/122

(58) Field of Classification Search ..... 36/122–125
See application file for complete search history.

(56) References Cited

U.S. PATENT DOCUMENTS

| | | | | |
|---|---|---|---|---|
| 3,600,829 | A * | 8/1971 | Violette | 36/124 |
| 4,720,927 | A * | 1/1988 | Abegg | 36/122 |
| 5,459,950 | A * | 10/1995 | Damm et al. | 36/122 |
| 5,517,773 | A | 5/1996 | Forrest et al. | |
| 5,720,120 | A * | 2/1998 | Smith | 36/124 |
| 6,112,436 | A | 9/2000 | Quellais | |
| 6,195,919 | B1 | 3/2001 | Forrest et al. | |
| 7,937,855 | B2 * | 5/2011 | Faber et al. | 36/122 |

FOREIGN PATENT DOCUMENTS

| | | |
|---|---|---|
| FR | 2 903 914 | 1/2008 |
| WO | WO2006085003 | 8/2006 |
| WO | WO2008000979 | 1/2008 |

* cited by examiner

*Primary Examiner* — Jila Mohandesi
(74) *Attorney, Agent, or Firm* — Thomas M. Freiburger

(57) ABSTRACT

A snowshoe of molded plastic material has a tail section with greater flexibility than the main body section, thereby allowing the tail to give and deform as the snowshoe tail is engaged against the terrain during the gait of the user. At the same time, the tail is stiff enough to provide flotation needed when the full weight of the user is on one snowshoe fully engaged against terrain, such as soft snow.

16 Claims, 5 Drawing Sheets

SNOWSHOE WITH FLEXIBLE TAIL

BACKGROUND OF THE INVENTION

This invention concerns snowshoes, especially molded plastic or composite snowshoes, and relates to improvements in the comfort and convenience of use of snowshoes.

Snowshoes are designed to provide enhanced flotation for a person walking over snow and ice surfaces, and to this end the snowshoes place on the user's foot a structure having a surface area larger than that of the foot. A snowshoe has larger dimensions in both length and width than a person's foot, and the lengthwise dimension is increased both forward of and behind the user's foot in order to keep a proper load balance on the snowshoe during use. Thus, the tail of a typical snowshoe extends substantially back from the heel of the user's foot. For this reason, walking with a snowshoe attached to the foot disrupts the normal gait of the user.

The snowshoe thus acts as a relatively long extension to the foot. Especially when considering this extension in the rearward direction, the portion of the user's gait where the heel of the foot would normally contact the ground, and the following motion of the user's foot and lower body extremities, are greatly affected. The extended length at the rear of the snowshoe comes into contact with the terrain surface earliest, and in a location far to the rear of the user's normal heel strike. The snowshoe then rotates about this rear point and produces unnatural rotation and leverage against the user's lower extremities during the portions of the gait cycle that follow, as the snowshoe rotates into full contact with the terrain.

It is an object of this invention to minimize the negative and unnatural effects presented by the presence of a snowshoe on a user's foot, and particularly to address issues associated with the extended length to the rear and the effects of the modified heel strike and subsequent gait-related motions.

The effect of a snowshoe on the natural gait of the user can be minimized by shortening the length of the snowshoe, particularly rear of the boot. This, however, has the negative effect of reducing the flotation area of the shoe, and as noted, proper load balance requires that the design include extensions both fore and aft of the user's foot.

Another approach that has been proposed has been to construct the tail of the snowshoe with an upwardly angled or curving shape. An example of this is a Tubbs snowshoe that can be seen on the website tubbssnowshoes.com. In this way the tail of the snowshoe is less disruptive to the gait of the user than in the case of relative flat tail portion of the same length. Although such an upward curve will somewhat decrease the flotation in this portion of the snowshoe, it will not have as negative an effect as shortening the snowshoe.

SUMMARY OF THE INVENTION

In the invention, the tail of the snowshoe is substantially more flexible than the central portion of the snowshoe. In this manner, the snowshoe tail deforms and bends during the heel strike portion of the gait, when the tail of the snowshoe first contacts the ground. With the heel portion bending and accommodating the gait in this way, the user is able to walk in a way that more approaches the user's normal gait without snowshoes. In addition and as another benefit, the flexibility and bending of the tail reduce the impact load associated with the heel strike portion of the gait, especially on relatively rigid terrain such as ice or crusted snow.

It is thus a primary object of the invention to provide a substantially more flexible tail in the snowshoe than typical of previous snowshoes, more flexible than the central portion of the snowshoe, so that the snowshoe tail will deform and bend during the heel strike portion of the gait, when the tail of the snowshoe contacts the ground. These and other objects, advantages and features of the invention will be apparent from the following description of a preferred embodiment, considered along with the accompanying drawings.

DESCRIPTION OF PREFERRED EMBODIMENTS

Figure 1:
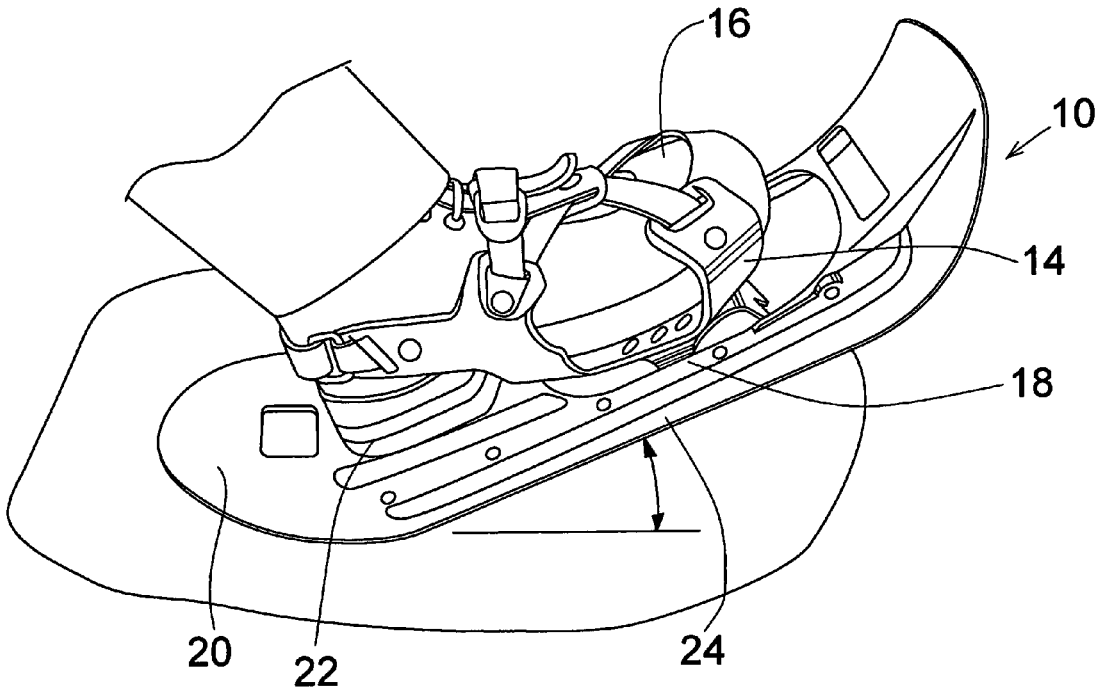
FIG. 1 is a perspective view showing a snowshoe of the invention in use and showing the snowshoe tail flexing.

In the drawings, FIG. 1 shows a snowshoe 10 having a molded snowshoe body 12 of plastic material supporting a boot binding 14. The boot binding is secured to the snowshoe in a known manner that permits pivoting of the binding and the attached user's boot 16 in the pitch direction, which can be via a pivot connection (not specifically shown) at 18.

In FIG. 1 the user is taking a step, and the snowshoe has just been brought into contact with the terrain. The tail 20 of the snowshoe first makes contact with the terrain, and typically just after this has occurred the user has lowered the boot heel 22 against the snowshoe deck as shown. As the user puts his weight through the heel against the snowshoe deck, the tail section 20 of the snowshoe 10 of the invention flexes to accommodate the user's gait, thus bending the snowshoe tail 20 upwardly in relation to the central section 24 of the snowshoe body. This makes the use of the snowshoe much more comfortable by effectively shortening the rear extension of the snowshoe during this portion of the gait. When the user brings the snowshoe to rest fully against the terrain, however, the tail section 20 still has sufficient stiffness to provide the flotation needed.

Figure 2:
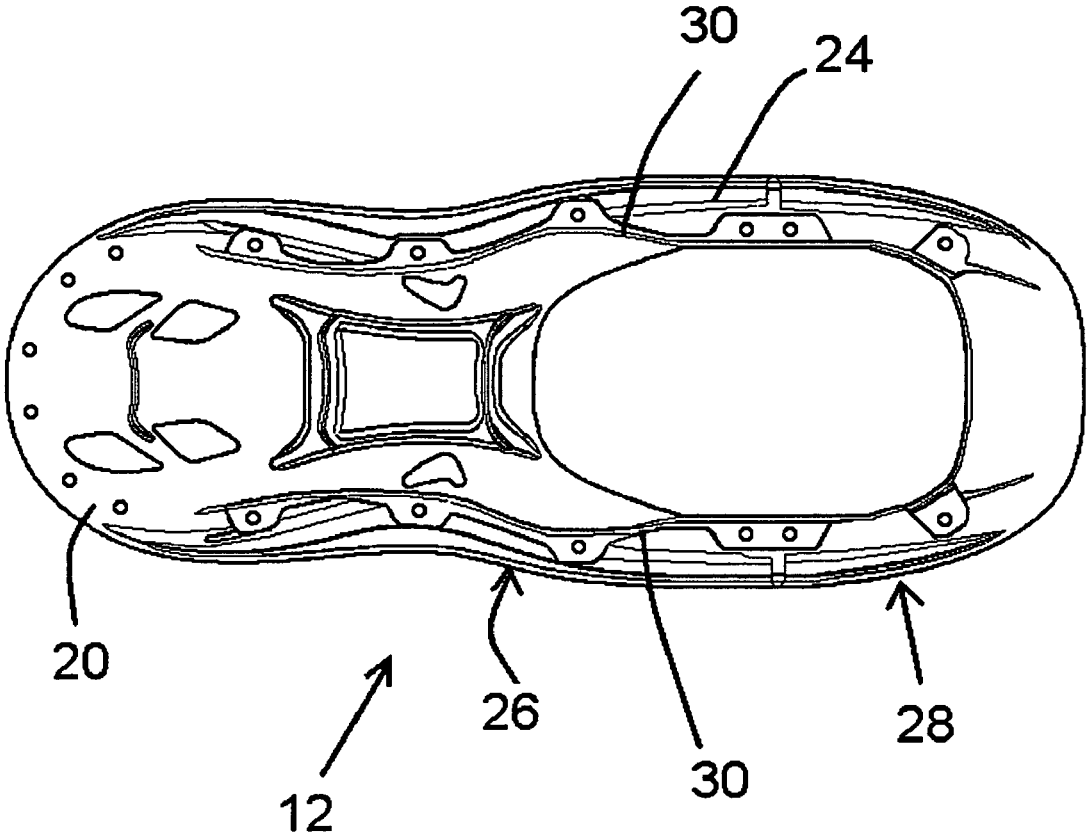
FIG. 2 is a bottom plan view of a molded snowshoe body according to the invention.
Figure 3:
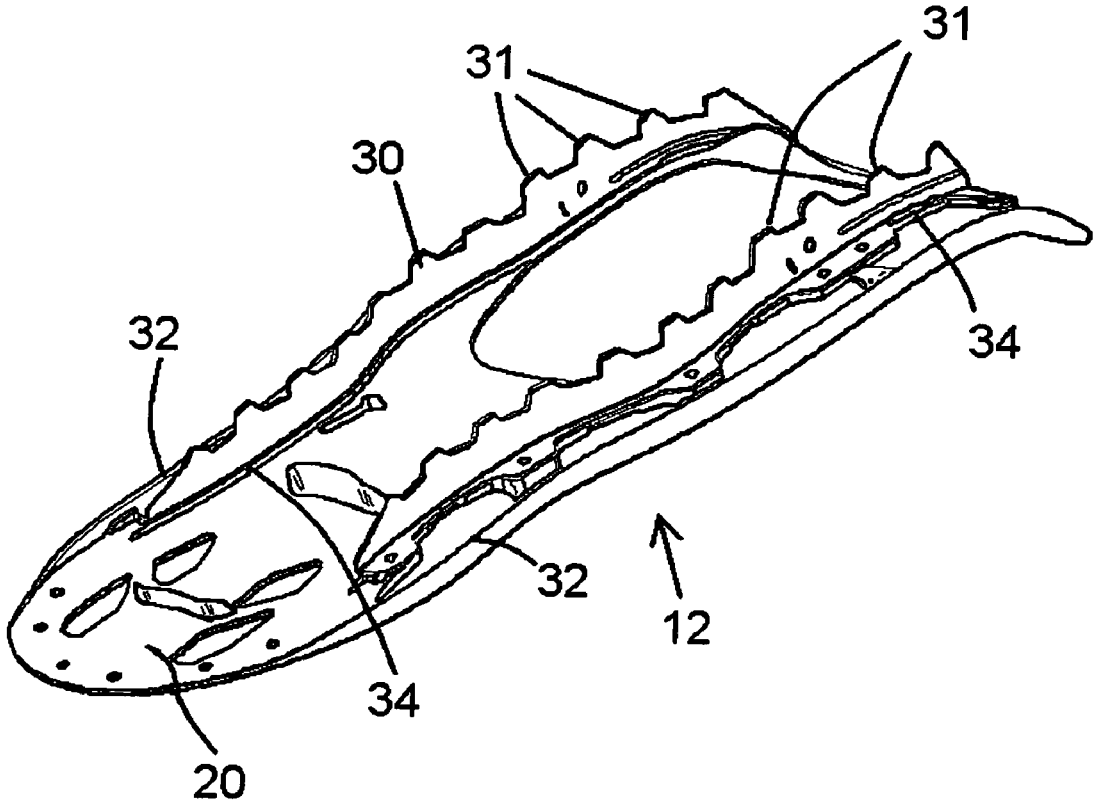
FIG. 3 is a perspective view showing the bottom of the snowshoe body.

FIGS. 2 and 3 show the underside of the snowshoe body 24. The tail section 20 preferably is rounded generally as shown, or blunt and somewhat curved. The body 24 is formed of molded plastic material, one example being polypropylene, with flexural modulus of about 1000-1750 MPa (depending on formulation). Another example is nylon, with flexural modulus in the range of about 1000-3000 MPa, depending on the specific nylon and the moisture level. In one preferred form of the invention the entire snowshoe body 24 can be formed of a rather flexible material but with at least a central region or section 26, and optionally part of a forward or nose section 28, reinforced with metal rails 30 secured to the bottom side of a snowshoe body. These are traction rails as well, with traction teeth 31 as shown. In addition, the snowshoe body can include integrally formed ridges, i.e. elongated bosses or ribs 32 and 34 as indicated. The ridges 32 are at the edges of the snowshoe and extend or curl downwardly from the deck. The ridges 34 preferably are sinuous as shown, following the metal rails, and there can be a pair of these ridges 34 along each metal rail 30. The metal rails and integral reinforcing ridges add rigidity to the main body or central section, i.e. the length of the snowshoe body through which the rails extend. In this way at least the central section 26 is relatively stiff in flexure, while the tail section 20 is not reinforced by metal rails and has little or no strengthening via integrally molded features. FIGS. 2 and 3 show the outer ridges 32 extending somewhat into the tail section but tapering down to zero height before the rear end of the tail, which is a preferred embodiment, but the configuration of the tail can vary so long as the stiffness is as defined herein. In addition, if needed, this tail section 20 can be of thinner material than the stiffer main body portion. Sufficient stiffness must be maintained in the tail section such that when the user stands flat on a level snow surface, the flexural deformation of the tail section are relatively small, and sufficient to significantly compromise the flotation afforded by the snowshoe.

Figure 4:
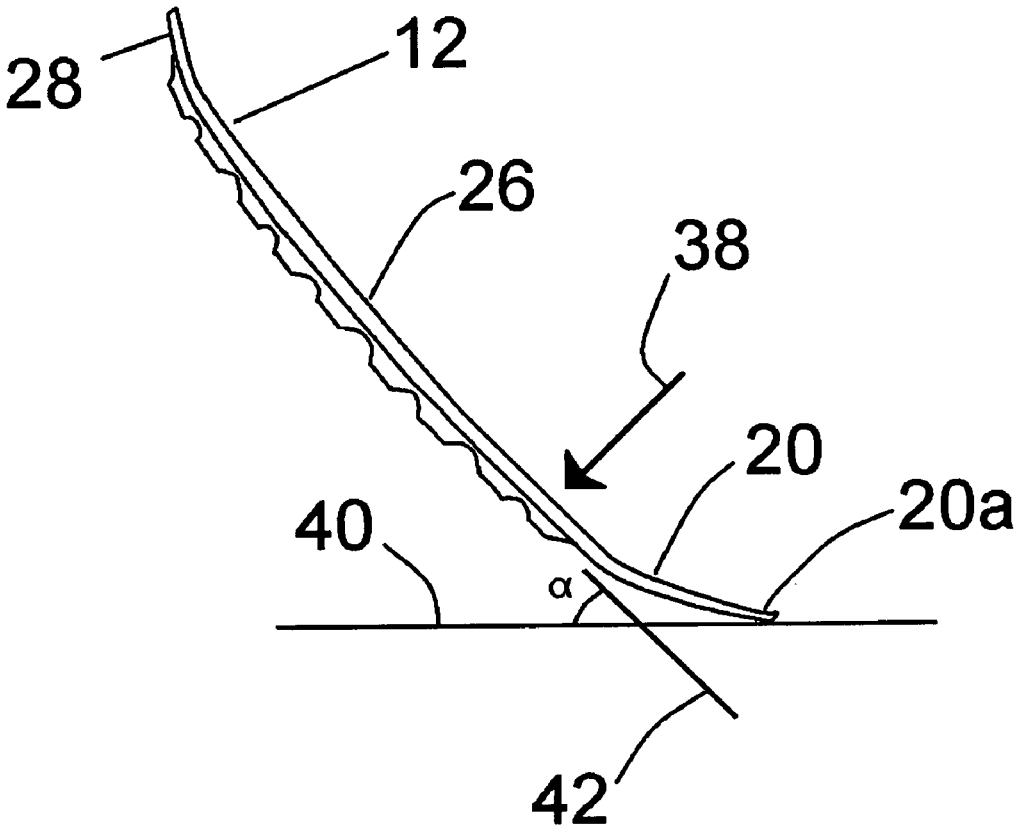
FIG. 4 is an elevation view showing the snowshoe of the invention with its tail flexing and showing angularity of the tail with respect to the central section of the snowshoe.

FIG. 4 is a side elevation view, somewhat schematic, showing the snowshoe body 12 of the invention with a load pressed on the snowshoe by the user following contact of the rear tip 20*a* of the tail portion 20 with the terrain surface. The load applied by the weight of the user is indicated by the arrow 38. Note that the flexible tail section is that portion of the molded body behind the metal rails 30, which give the central body portion most of its stiffness. In FIG. 4, the snowshoe body is, of course, restrained at the central section 26 by the connection of the binding (not shown in FIG. 4) to the snowshoe body; this prevents the force 38 from simply pushing the central and upper portion of the snowshoe body down flatly against the terrain. Thus, with the force applied approximately at the location of the arrow 38, the flexible tail section 20 behind that point flexes, bending in a curve, the geometry of which depends on the stiffness along the length of the tail section 20 (i.e. the tail section may vary in strength through its length, as by a tapering thickness or other features).

The line 40 in FIG. 4 represents not necessarily the terrain, but a parallel to the snowshoe tail section at the rear tip 20*a*. This is a tagent line at the tip 20*a* if the entire profile of the tail section 20 is assumed to be a curve. The line 42 in FIG. 4 is parallel to the central or main body section 26 of the snowshoe body. Thus, the angle alpha in FIG. 4 represents the change in angle of the tail section tip 20*a* due to bending by forced contact of the tip 20*a* with the terrain during the user's gait. In a preferred embodiment of the invention, this angle is at least about 20°, and more preferably in the range of about 30° to 45°. This assumes the user is within the weight range for which the particular snowshoe is designed.

One model of TSL snowshoe will flex somewhat in the tail when nearly all a user's weight is pushed down through the heel, with the snowshoe generally in the configuration shown in FIG. 4. However, the tail section of the TSL snowshoe is roughly two or three times as stiff as that of the invention, and the bend that forms in the TSL snowshoe actually extends from the center portion of the snowshoe, forward of the heel strike area, back to the tip of the heel. The TSL snowshoe has a fairly uniform stiffness throughout its length, and when forced to bend, the snowshoe body actually bends through a much greater portion of its length than merely the tail. In addition, the geometry of the TSL snowshoe is different, with a tail section that narrows in a sharp taper and has a tab extending back at its rear tip.

The flexible tail portion 20 may have a length, for example, of about five or six inches in a snowshoe having an overall length of 24 inches. Thus, it may be about 21%-25% of the length of the snowshoe; tail length preferably changes with snowshoe length. More broadly, the tail may occupy a length of about 20% to 30% of the overall snowshoe. The bendability of the tail section 20 can be expressed as a function of bending moment applied to the tail section. In a preferred embodiment the tail section will bend through an angle alpha of at least about 30° with the application of about 200-250 inch pounds (22.6-28.25 newton-meters) to the tail section. This would be the case, for example, if a force at the arrow 38 is about 40-50 pounds (for an approximately 180 pound person) and the tail section 20 is about five inches in length. Approximately commensurate with the above bending characteristics, the tail section should generally have a bending modulus in an approximate range as described above to perform in the manner desired.

The bendable tail section 20 allows deflection during the heel strike portion of the user's gait in a manner that reduces the effective length of the heel portion or rear deck of the snowshoe and reduces the impact forces associated with the heel strike against the snowshoe. This results in a lower moment exerting pressure on the user's knee. Walking with these snowshoes is more comfortable.

The flexibility of the tail section can be realized in several different ways. One way is to simply mold the tail section in a relatively thin dimension, e.g. approximately 3 mm to 4 mm, with no stiffening elements either integrally molded into the tail section or attached (such as metal rails) to that section. As another example, the softer tail section can be achieved by modifying structural elements molded into the snowshoe body design such that the flexural stiffness in the tail section is greatly reduced. For example, transverse grooves can be provided in sections of the tail structure having significant depth, thus flexibilizing these regions. Another way of forming the flexible tail section is to construct the tail section 20 from a more flexible material than the central section 26. This option requires either co-molding with different materials, or a separately molded tail section, attached mechanically to the central section, such as by mechanical fasteners, possibly with metal strips extending across the joint.

Figure 5:
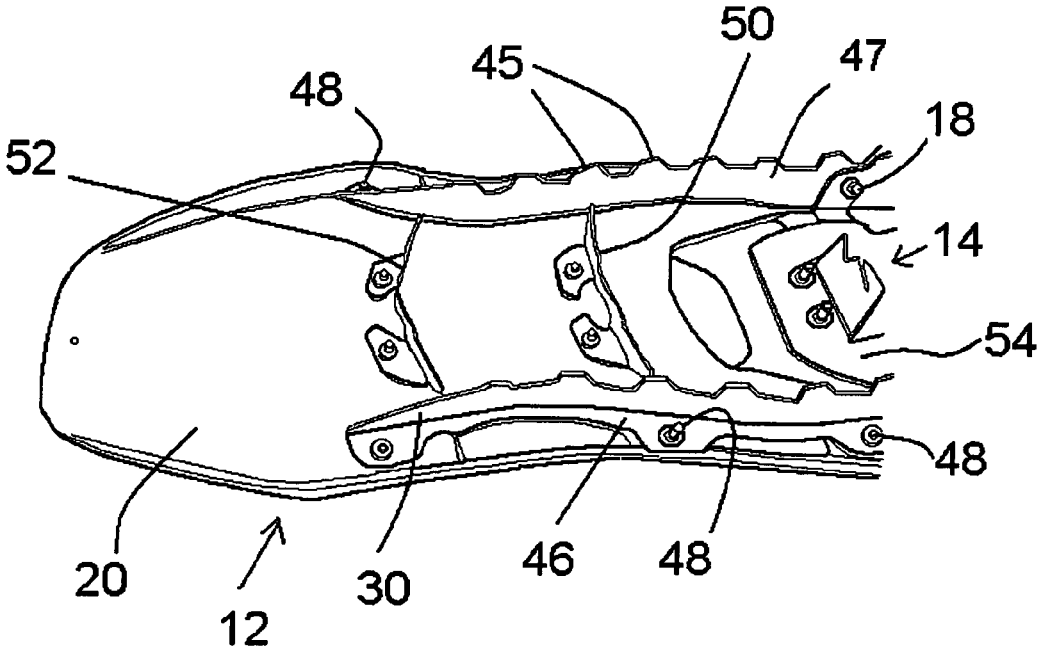
FIG. 5 is a perspective view showing a portion of the bottom of a snowshoe with a flexible tail pursuant to the invention.

FIG. 5 is a bottom perspective view showing a portion of the snowshoe of the invention. The flexible tail section is shown at 20. Stiffening rails are shown at 30, with cleats or teeth 45 in vertical walls or flanges 47 for traction. These rails are of an L shaped cross section and have base sides or flanges 46 that provide for attachment of the stiffening rails to the molded snowshoe body 12, with fasteners 48 such as rivets. FIG. 5 shows rear cleats 50 and 52 secured to the snowshoe at a position where the user's heel will strike against the snowshoe deck after the snowshoe tail 20 comes into contact with terrain. Although a single heel cleat could be provided, two spaced apart cleats 50 and 52 are included on this snowshoe. The snowshoe has a boot binding 14, a portion of which is visible in FIG. 5, including a toe cleat structure 54. The binding pivots about pivot connections 18 on each side, one side being visible in FIG. 5.

The stiffening rails 30 preferably are sinuous in shape, as best seen in FIGS. 2, 3 and 5. They generally follow the contour of the snowshoe body 12 near the peripheral edge, and may include two reverse curves as shown, i.e. four curves through the length of a rail. In addition the rails 30 curve upwardly as they extend into the nose section 28 as seen in FIG. 3. The sinuous shape improves traction. These rails can be formed of stainless steel or a powder coated steel protected from corrosion. In one preferred form the rails are steel, about 1.2 to 1.5 mm thick, with a vertical flange of about 15 to 30 mm and a horizontal flange of about 4 to 18 mm. The horizontal flange can vary in width, wider at fastener points as shown in FIGS. 2, 3 and 5.

Also, a preferred embodiment of the snowshoe of the invention will have a nominal decking thickness of about 3.5 mm, and a maximum height of about 21 mm from bottom to top at side edges ridges or ribs 32, in the main body section where the height increases. These ribs preferably enter the tail section as shown, but the thickness of the ribs tapers to zero about midway back into the tail. The stiffness of the tail, i.e. resistance to bending, preferably is about 1300 lb-in$^2$ to about 2000 lb-in$^2$, at least at a point immediately behind the metal rails 30 which begins the tail section. Stiffness preferably lessens somewhat toward the end of the tail. The stiffness (as resistance to bending) of the tail is calculated as EI, where I is a function of dimension of an approximately rectangular cross section (basically bh$^3$/12, with b and h representing base dimension and height dimension), in a fourth power (in$^4$), and E is Young's modulus or modulus of elasticity of a material, in psi. With a molded deck formed of polypropylene of Young's modulus about 218,000 psi, for example, the stiffness EI at the forward end of the tail is about 1310 pound-in$^2$. By comparison the TSL snowshoe mentioned above has a stiffness of about 6550 (essentially constant through the snowshoe length) and an MSR snowshoe has a deck stiffness of about 4200, including in the tail.

The steel rails 30 greatly stiffen the center region of the snowshoe. There, the stiffness is essentially the stiffness of the metal traction rails plus that of the molded deck material with its molded-in ribs. The stiffness of the molded deck, however, is much less than that of the rails.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe, comprising:

a molded snowshoe body, having an open area in a forward portion of the body, a boot binding connected to the snowshoe body so as to allow pitch pivoting of the snowshoe body relative to the boot binding so that a forward end of the boot binding can swing down into the open area during part of the user's gait, the snowshoe body having a stiff portion extending at least through a longitudinally central section of the snowshoe, and a tail section extending back from the central section, the tail section being more flexible than the central section such that the tail section is more bendable in pitch than the central section, whereby, when a user walks with the snowshoe and contacts the terrain with the rear end of the tail section, then lowers the user's heel in the binding downward against the snowshoe body and exerts force from the heel downward onto the snowshoe body, the tail section will bend upward relative to the central section thus accommodating the user's gait in the manner of a shorter-tail snowshoe and improving the comfort and ease of walking with the snowshoe.

2. The snowshoe of claim 1, wherein the flexibility of the tail section in the pitch direction is sufficient that the rear end of the tail section, when the snowshoe is worn by a user within a weight range for which the snowshoe is prescribed, will bend through an angle of at least about 20°.

3. The snowshoe of claim 2, wherein said angle in the rear end of the tail section will bend through an angle of about 30° to 45°.

4. The snowshoe of claim 1, wherein the flexibility of the tail section in the pitch direction is sufficient that the rear end of the tail section, when the snowshoe is worn by a user within a weight range of at about 150 pounds to 175 pounds, will bend through an angle of at least about 30°.

5. The snowshoe of claim 1, wherein the flexibility of the tail section in the pitch direction is sufficient that the rear end of the tail section, when about 200-250 inch-pounds bending moment is applied on the tail section, will bend through an angle of at least about 30°.

6. The snowshoe of claim 1, wherein the rear end of the tail section is bluntly rounded in shape.

7. The snowshoe of claim 1, wherein the molded snowshoe body is a single integrally molded component, having contoured ridges extending essentially longitudinally in the molded body in the central section for increased rigidity of the central section.

8. The snowshoe of claim 7, wherein the snowshoe further includes generally longitudinally extending metal rails fixed to a bottom side of the central section of the snowshoe body, adding significant stiffness to the central body section.

9. The snowshoe of claim 8, wherein the metal rails are generally L shaped in cross section, with a vertical portion that includes traction teeth for engaging downwardly against terrain.

10. The snowshoe of claim 1, wherein the snowshoe further includes generally longitudinally extending metal rails fixed to a bottom side of the central section of the snowshoe body, adding significant stiffness to the central body section, and the metal rails not extending into the tail section.

11. The snowshoe of claim 10, wherein the tail section has a bending resistance, at least at a position immediately rear of the metal rails, in the range of about 1000 lb-in$^2$ to about 2000 lb-in$^2$.

12. The snowshoe of claim 11, wherein the bending resistance in the tail section immediately rear of the metal rails is approximately 1300 lb-in$^2$.

13. The snowshoe of claim 10, wherein the metal rails are sinuous through their length, with at least three curves through the length of each rail, and the rails having traction teeth at their lower edges for engagement with terrain, whereby the sinuousness of the rails increases traction with terrain.

14. The snowshoe of claim 1, wherein the tail section has a bending resistance, at least at a position at the forward end of the tail section, in the range of about 1000 lb-in$^2$ to about 2000 lb-in$^2$.

15. The snowshoe of claim 1, wherein the molded snowshoe body is a single integrally molded component, having contoured ridges extending essentially longitudinally in the molded body in the central section for increased rigidity of the central section, the contoured ridges extending back into the tail section, tapering down in height in the tail section and ending at a position forward of the rear end or the tail section.

16. A snowshoe with a flexible tail, comprising:

a molded plastic snowshoe body, with an open area in the forward portion of the body, a boot binding connected to the snowshoe body in a manner as to allow pitch pivoting of the boot binding relative to the snowshoe body as the user lifts a foot, swinging a forward part of the boot binding down into the open area, the snowshoe body having a longitudinally central section which is relatively stiff and resistant to bending in the pitch direction, and a tail section extending back from the central section and being substantially more flexible than the central section such that the tail section is substantially more bendable in the pitch direction than is the central section, whereby the snowshoe tail section bends as a user steps forward with the snowshoe and contacts terrain with a portion of the user's weight pushed against the central section through the user's boot, improving comfort and ease of walking with the snowshoe.

* * * * *